US006268555B1

(12) United States Patent
Vochezer

(10) Patent No.: US 6,268,555 B1
(45) Date of Patent: Jul. 31, 2001

(54) CHIN REST FOR A MUSICAL INSTRUMENT

(75) Inventor: Georg Vochezer, Argenbuehl (DE)

(73) Assignee: Rudolf Wittner GmbH & Co., Isny (DE)

( * ) Notice: Subject to any disclaimer, the term of this patent is extended or adjusted under 35 U.S.C. 154(b) by 0 days.

(21) Appl. No.: 09/611,921

(22) Filed: Jul. 7, 2000

(30) Foreign Application Priority Data

Jul. 7, 1999 (DE) ..... 199 31 382

(51) Int. Cl.[7] ..... G10D 1/02
(52) U.S. Cl. ..... 84/279; 84/278; 84/280; 84/281
(58) Field of Search ..... 84/278, 279, 280, 84/281

(56) References Cited

U.S. PATENT DOCUMENTS 439,199 * 10/1890 Schuster ..... 84/279
714,658 * 12/1902 Barginde ..... 84/311
1,204,642 * 11/1916 Becker ..... 84/279

FOREIGN PATENT DOCUMENTS 503 666 7/1930 (DE) .
1 017 891 10/1957 (DE) .
43 02 804 2/1994 (DE) .

* cited by examiner

*Primary Examiner*—Shih-Yung Hsieh
(74) *Attorney, Agent, or Firm*—Barry R. Lipsitz

(57) ABSTRACT

In order to improve a chin rest for a musical instrument having a chin support and a holding device for holding the chin support on the musical instrument, with the holding device comprising at least one clamping element which is adjustable for clamping the chin support to the musical instrument in a clamping direction, such that it is easy and safe to use, it is proposed that the chin support be provided with an insertion guide for the at least one clamping element, and that the insertion guide be arranged and designed such that the inserting direction is at an incline to the clamping direction.

31 Claims, 3 Drawing Sheets

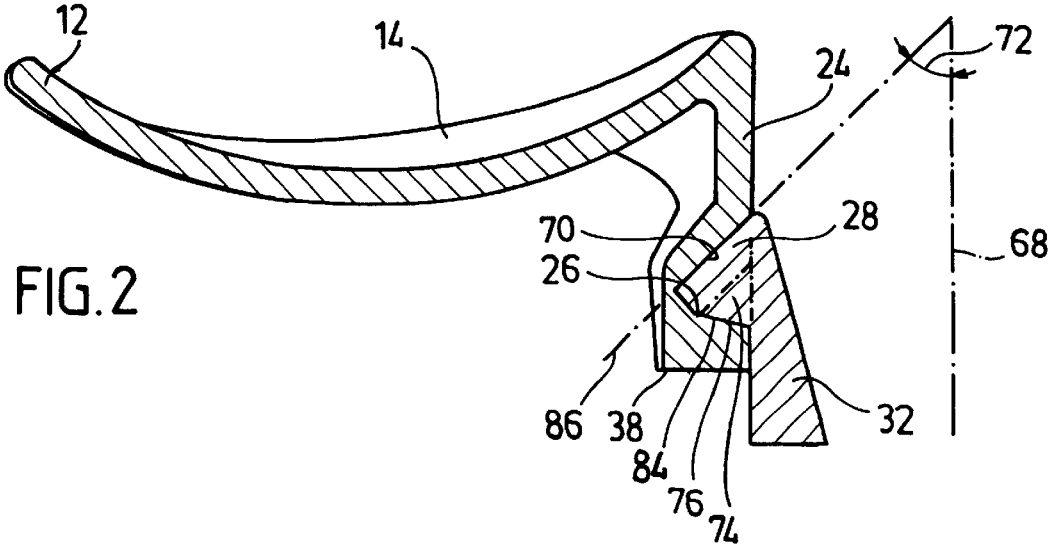
FIG.2
FIG.3
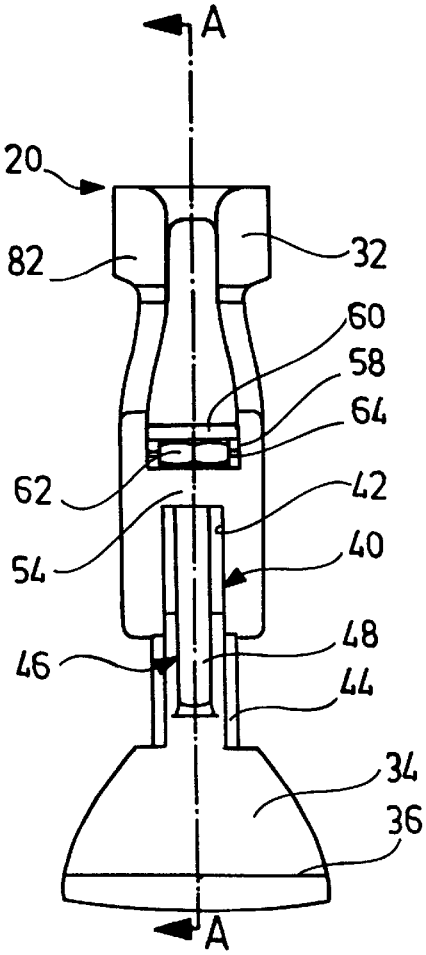
FIG.4
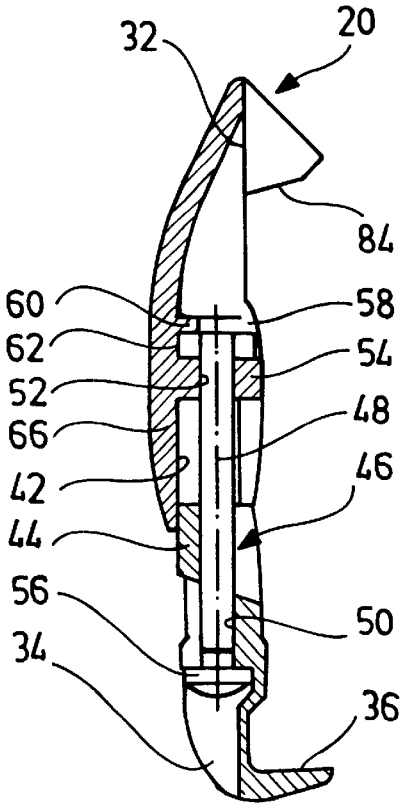

CHIN REST FOR A MUSICAL INSTRUMENT

BACKGROUND OF THE INVENTION

The invention relates to a chin rest for a musical instrument having a chin support and a holding device for holding the chin support on the musical instrument, with the holding device comprising at least one clamping element which is adjustable for clamping the chin support to the musical instrument.

Such chin rests are used, in particular, for stringed instruments such as the violin or the viola, so as to be able to hold the musical instrument more easily and more safely.

A chin rest for violin-type instruments which comprises a carrier formed of tubular sections and adjoining a chin rest is known from DE 43 02 804 C2.

A chin rest wherein the chin support is attached by means of tightener clamps to the instrument is known from DE 359 170.

A shoulder support for violins with a cushion which is adjustably attached to an arm is known from DE 503 666.

DE 1 017 891 discloses a device for attaching a chin rest to violins, which comprises a bracket in the form of a resilient clip.

Departing from this prior art, the object underlying the invention is to so improve a generic chin rest that it is easy and safe to use.

SUMMARY OF THE INVENTION

This object is accomplished with a chin rest of the kind described at the outset, in accordance with the invention, in that the chin support comprises an insertion guide for the at least one clamping element, and in that the insertion guide is arranged and designed such that the inserting direction is at an incline to the clamping direction.

Owing to the inventive chin rest, the clamping element or elements does or do not have to be permanently fixedly connected to the chin support, but, as required, can be inserted for clamping the chin rest to the musical instrument or removed by way of the insertion guide. Thus, the inventive chin rest can be stored and transported in a space-saving way, and the chin rest can be quickly and easily assembled and disassembled. In the chin rests known from the prior art, on the other hand, the holding device with the clamping elements is permanently fixedly connected to the chin support. Such chin rests are thus bulky and difficult to transport.

One is freer in the choice of material for the clamping elements than with the devices known from the prior art because in the inventive chin rest an insertion guide is provided for the clamping elements. As the clamping elements in the prior art are fixedly connected to the chin support, corresponding threads or the like have to be provided on these in order to fixedly connect them t o the chin support.

However, one is then essentially limited to metals as material for the clamping elements, and the problem arises that when playing the musical instrument and, in particular, a violin, the metal of the clamping elements comes into contact with the particularly sensitive skin of the neck and face of the player. This can cause or intensify allergies such as nickel allergies in persons who are sensitive to it. It has also to be taken into account that an increased pressure is exerted on the skin by the clamping of the musical instrument, which additionally increases the likelihood of causing allergies. People who already suffer from allergies cannot use the chin rests known from the prior art.

With the devices known from the prior art, it has also to be taken into consideration that the metallic tubular part of the clamping element has to be arranged at a certain distance from the musical instrument when the chin rest is clamped so as to avoid damage to the musical instrument by the metallic part during clamping and to achieve the fixed connection of the clamping element by means of an arc-shaped element to the chin support. However, the metallic parts then press more heavily against the skin.

Since there is no necessity for threads in the inventive chin rest owing to the insertion guide, the clamping elements can be designed such that there is no contact between metal parts causing allergies and the skin of the player, and, in particular, well-tolerated materials can be used.

The inventive chin rest, therefore, meets the requirements of the EU directive 94/27/EC for circulating products containing nickel, which come into contact with the skin directly and for a long time and thus cause allergic reactions because this contact is avoidable in accordance with the invention.

It is particularly advantageous for the at least one clamping element to be releasably held by means of the insertion guide on the chin support. In this way, the chin rest can be stored and expediently transported in a space-saving manner. By inserting the clamping elements, the chin rest can be assembled and disassembled accordingly in a time-saving manner, and, therefore, starting from the disassembled state it is also connectable in a time-saving manner to the musical instrument.

The inserting direction can lie at an angle to the clamping direction in the range of between 20° and 70°. It is particularly advantageous for this angle to lie in the range of between 35° and 55°. It is thereby ensured that the clamping element is easily insertable into the insertion guide and when the chin rest is clamped not too strong a load is exerted on a corresponding holding head. It is particularly advantageous for the angle to lie essentially at 45° because when the clamping direction is essentially perpendicular to a corpus of the musical instrument, an optimum between good insertability of the clamping element and minimum load during clamping is achievable.

From a production manufacturing point of view, it is particularly expedient for the insertion guide to be formed by a recess in the chin support. Chin supports are usually made of wood. The insertion guide can then be made by simple milling on the chin support.

In a variant of an embodiment, provision is made for an insertion guide for a clamping element to comprise a guide channel for the clamping element. The clamping element can thereby be safely inserted into the insertion guide and also held there.

To ensure a good hold of the clamping element on the supporting element for the clamping between chin support and musical instrument, and, in particular, to avoid tilting and the like, the insertion guide expediently comprises a support channel communicating with the guide channel. By way of the support channel, a holding surface of the clamping element on the insertion guide can be increased, and, in particular, the forces caused by the clamping can be absorbed better. To this end, the support channel expediently comprises a contact surface for the clamping element which essentially lies perpendicular to or at a small angle to th e clamping direction. This enables good absorption of the clamping forces acting between musical instrument and chin support via the clamping element.

It is particularly expedient for the insertion guide for a clamping element to comprise two separate guide channels.

The clamping element is thereby safely held in the insertion guide and also easily insertable.

To ensure good clamping between chin rest and musical instrument, a clamping element is expediently of two-part design with a connecting element to connect with the chin support and a holding foot to rest against the musical instrument. Thus, in a structurally simple way, a clamping force is exertable via a movement of these two parts relative to each other.

In order to adjust and fix the relative position between connecting element and holding foot, the clamping element expediently comprises an adjusting device. By means of this, a clamping force can then be exerted in a definite way via the clamping element on the musical instrument in order to thus clamp the chin support via the holding foot of the clamping element or elements to the musical instrument.

In a structurally particularly simple embodiment, the adjusting device comprises a screw connection. From a production manufacturing point of view, it is then particularly easy for the clamping element to comprise a counter receptacle for the screw connection. Thus, in a simple way a relative movement between connecting element and holding foot is achievable and so a good clamping between musical instrument and chin support can thus also be brought about.

It is particularly expedient for a screw nut to be rotationally fixedly arranged in the counter receptacle. Thus, threaded bores in the clamping element can be dispensed with and the choice of material is therefore not limited thereby. Furthermore, the adjusting device can then be constructed with a few parts, i.e., essentially with two parts, namely the set screw and the pertaining screw nut.

The counter receptacle is expediently arranged in the connecting element. Thus, by actuation of the screw from the underside of the musical instrument, the chin rest can then be clamped to the musical instrument.

It is particularly expedient for the screw connection to be arranged within the clamping element. Thus, the metallic screw is surrounded or embedded by the chosen material of the clamping element which is kind to the skin, and the player of the musical instrument with the chin rest held thereon does not come into contact with the metal of the screw In order to ensure in a simple way good displaceability between connecting element and holding foot, the connecting element expediently comprises a displacement guide for the holding foot.

The connecting element advantageously comprises a holding head whose design is adapted to the insertion guide. A secure hold of the inventive chin rest on the musical instrument is thereby achieved.

To this end, in a variant of an embodiment, the holding head comprises a guide web which is adapted to a guide channel of the insertion guide. This enables good insertion of the clamping element into the insertion guide and a safe hold.

To achieve a large holding surface, the guide web is advantageously arranged on the holding head so as to lie at the outer sides thereof. The holding head further expediently comprises a contact surface for resting against a corresponding contact surface of a support channel of the insertion guide. In this way, the clamping force can be well absorbed by the insertion guide via the holding head, and there is a safe and stable hold.

In particular, in order to enable manufacturing of the holding head by means of an injection molding process, the holding head has an essentially U-shaped profile at that end which is provided for insertion into the insertion guide. Tooth-shaped profiles or similar profiles can also be provided. On the one hand, a good hold is thereby achieved because the holding head is not of solid construction and also corresponding inner surfaces can contribute to the hold, and, on the other hand, this construction is well suited for injection molding processes.

Expediently guide webs are formed at the sides of that end which is provided for insertion into the insertion guide. These reinforce the hold by enlarging the holding surface.

In a particularly advantageous embodiment, those parts of a clamping element which may come into contact with the player's skin when the musical instrument is held by means of the chin rest are made from a material which is kind to the skin, and, in particular, from a plastic material which is kind to the skin. Direct contact between skin and metal is thereby avoided, and the inventive chin rest can also be used by persons suffering from metal allergies, and the risk of metal allergies developing is reduced.

Expediently, the connecting element is made in its entirety of a plastic material, and the holding foot is also made from a plastic material.

In order to be able to manufacture the connecting element economically by means of an injection molding process, a holding head of the clamping element is expediently designed such that the walls forming it have essentially the same wall thickness.

To this end, the holding head advantageously comprises a central recess, as a result of which, on the one hand, the wall thicknesses are uniform, and, on the other hand, the holding surface is increased.

In an advantageous variant of an embodiment, the holding device comprises two clamping elements. Owing to the provision of two clamping elements, the chin support is held in a safe way on the musical instrument, and the number of parts to be provided for the holding device is small. Accordingly, two insertion guides arranged in spaced relation to each other are then to be provided for accommodating the two clamping elements.

BRIEF DESCRIPTION OF THE DRAWINGS

FIG. 2 a sectional representation taken along line B—B of FIG. 1;

FIG. 3 a front view of an inventive clamping element;

FIG. 4 a sectional representation of the clamping element of FIG. 3 taken along line A—A;

Figure 1:
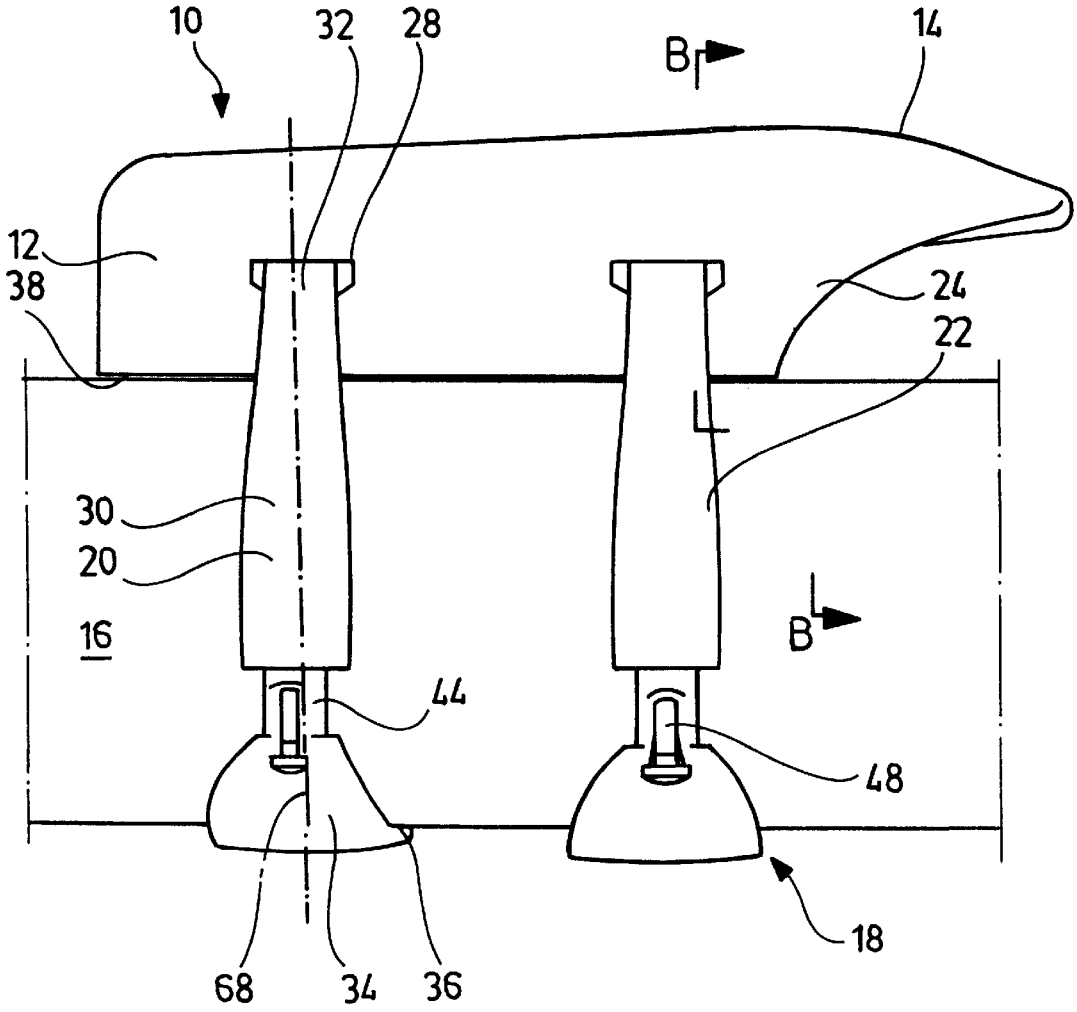
FIG. 1 a side view of an inventive chin rest held on a musical instrument.

An inventive chin rest generally designated 10 in FIG. 1 comprises a chin support 12. A surface 14 of this chin support 12 is adapted to the anatomy of the face.

A holding device generally designated 18 is provided for holding the chin support 12 on a musical instrument 16. The holding device 18 comprises a first clamping element 20 and a second clamping element 22, which are held in spaced relation to one another on the chin support 12. The two clamping elements 20, 22 are basically of the same design.

Figure 6:
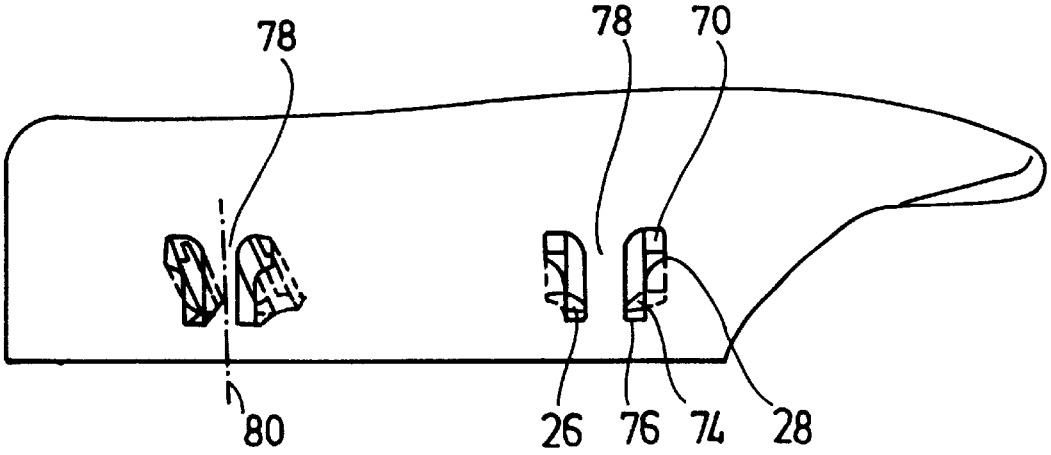
FIG. 6 a side view of a chin support with insertion guides.

The chin support 12 comprises in the direction towards the musical instrument 16 an elevated edge 24 (FIG. 2), in which insertion guides 28 associated with the clamping elements 20 and 22, respectively, are formed by recesses 26 (FIGS. 2 and 6).

The clamping element 20 and 22, respectively, comprises a connecting element 30 with a holding head 32 integrally formed thereon. The connecting element 30 is provided for connecting the clamping element 20 and 22, respectively, to the chin support 12 by sliding the holding head 32 into the insertion guide 28. A clamping element 20, 22 further comprises a holding foot 34 with an L-shaped profile (FIG. 4) by which a contact surface 36 for the holding foot 34 is formed on the musical instrument 16. The contact surface 36 is provided with a suitable cushion, for example, a piece of cork. A contact surface 38 of the chin support 12 is similarly provided with a suitable cushion against the musical instrument 16.

DETAILED DESCRIPTION OF THE INVENTION

Figure 5:
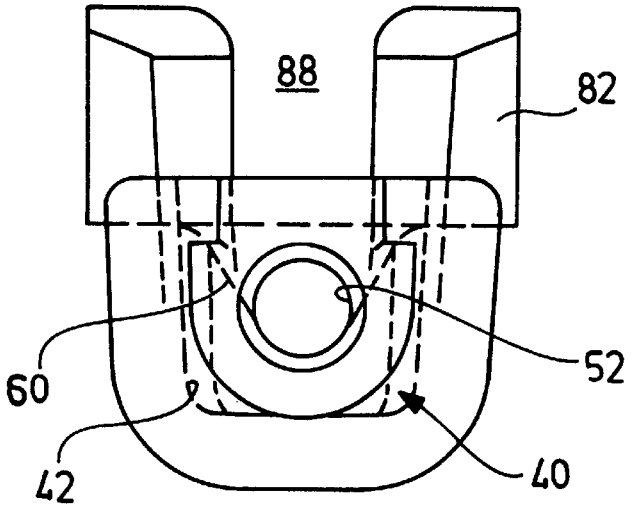
FIG. 5 a bottom view of an inventive connecting element.

The holding foot 34 is guided in the connecting element 30 for displacement in a longitudinal direction of the connecting element 30 by means of a slide guide 40 (FIGS. 3 and 5). For this purpose, the connecting element 30 comprises in its longitudinal direction towards its end remote from the holding head 32 a recess 42 of approximately semicircular or rectangular cross section with rounded edges. The holding foot 34 comprises a corresponding leg element 44 which is guided in the recess 42.

A setting device 46 (FIGS. 3 and 4) is provided for adjusting and fixing the relative position between the connecting element 30 and the holding foot 34 and thus fixing the length of the clamping element 20 and 22, respectively, between holding head 32 and holding foot 34. The setting device 46 comprises a set screw 48 arranged in the longitudinal direction of the connecting element 30. The set screw 48 is guided through an opening 50 in the leg element 44 of the holding foot 34 and through an opening 52 in a connecting web 54 at the end of the recess 42. A screw head 56 is accessible from the end of the holding foot 34.

A counter receptacle 58 is provided for the set screw 48. For this purpose, a screw nut 62 is rotationally fixedly arranged between the end of the connecting web 54 facing the holding head 32 and a further connecting web 60 arranged in spaced relation thereto. This is, for example, achieved by side walls between the connecting webs 54 and 60 comprising an elevation 64, and the diameter of the screw nut 62, which, in particular, is in the form of a hexagonal nut, being so adapted to the elevation that when turning the set screw 48, the screw nut 62 cannot turn along with it. In a variant of an embodiment, the spacing between the connecting webs 54 and 60 is selected such that the screw nut 62 is clampable therebetween and is unable to fall out.

The set screw 48 is arranged within the clamping element 20 and 22, respectively, such that it is shielded by an outer wall 66 of the connecting element 30 from contact with the player of the musical instrument when the chin rest is clamped and is guided in the leg element 44 such that there is no contact with the player's skin.

The connecting element 30 and the holding foot 34 are displaceable in the longitudinal direction relative to each other and fixable relative to each other by means of the setting device 46. With the holding head 32 connected to the chin support 12, the chin support is thereby clampable to the musical instrument 16 via the clamping elements 20, 22, with the clamping direction 68 being the longitudinal direction of the connecting element 30. With the chin support 12 positioned via the contact surface 38 on the musical instrument, and the clamping elements 20, 22 inserted into the insertion guide 28, the clamping direction is essentially perpendicular to a soundboard of the musical instrument 16. The insertion guide 28 formed by a recess 26 comprises, as shown in FIGS. 2 and 6, a guide channel 70 which is arranged at an incline to the clamping direction 68 at an angle 72. This angle lies in the range of between 20° and 70°, and preferably between 35° and 55°. It is particularly preferred for it to be approximately 45°. The insertion guide 28 further comprises a support channel 74 which communicates with the guide channel 70 and comprises a contact surface 76 facing the musical instrument 16 (when the chin rest is held on the musical instrument). The contact surface 76 is arranged essentially perpendicular to the clamping direction 68 or at a small angle thereto (smaller than approximately 15°) and serves to support the holding head 32 when the chin support is clamped against the musical instrument 16 via the clamping elements 20, 22. The guide channel 70 is of broader construction than the support channel 74 in a direction perpendicular to the clamping direction 68, so that the recess 26 has at the elevated edge 24 towards the front the shape of an L standing on its head (FIG. 6).

In the embodiment shown in FIG. 6, the insertion guide 28 for a clamping element 20 and 22, respectively, comprises two separate guide channels 70, each having a support channel 74 associated therewith. A central wall 78 is arranged between the guide channels 70. The guide channels 70 and support channels 74 are arranged symmetrically in relation to a center plane 80 of this central wall 78.

The recesses 26 for the insertion guide 28 are preferably made by milling from the side surface of the chin support 12 made of wood or plastic.

The holding head 32 of the clamping element 20 and 22, respectively, is adapted to the corresponding design of the insertion guide 28. For this purpose, it comprises at its upper end guide webs 82 (FIG. 5), which are arranged at the angle 72—at the angle between the clamping direction 68 and the guide channels 70—in relation to the longitudinal direction of the connecting element 30. The guide webs 82 serve for insertion into the guide channels 70 of the insertion guide 28. For adaptation to the insertion guide 28, they are arranged on the holding head 32 so as to lie at the outer sides thereof.

The holding head 32 comprises two guide webs 82 arranged in spaced relation to each other. As shown in FIG. 5, the profile of the holding head 32 is U-shaped in a viewing direction perpendicular to the guide webs 82. In a viewing direction from a front or rear end of the guide webs 82, the end of the holding head 32 has an L-profile with respect to a guide web 82. A central recess 88 is adapted to the central wall 78.

The holding head 32 further comprises a contact surface 84 which is adapted to the contact surface 76 of the insertion guide 28, i.e., it has in relation to the longitudinal direction of the connecting element 30 the same angle as the contact surface 76 in relation to the clamping direction 68.

The clamping element 20 and 22, respectively, is preferably made of a plastic material (except for the set screw 48 with the screw nut 62) which, in particular, is kind to the skin.

The connecting element 30 and the holding foot 34 are made by injection molding. To enable simple and cost-efficient manufacture, the holding head 32 of the connecting element 30 is of such design that the walls forming it have essentially the same wall thickness.

The inventive chin rest is to be used as follows:

Owing to the provision of an insertion guide 28 and holding head 32 of the clamping elements 20 and 22, respectively, adapted thereto, the chin rest 10 can be stored, kept or transported in a space-saving way with the chin support 12 and clamping elements 20, 22 not attached. For attachment to the musical instrument 16, the clamping elements 20, 22 are introduced in an inserting direction 86 at an incline to the later clamping direction 68 into the respective insertion guides 28. The chin support 12 is placed on the musical instrument 16 via the contact surface 38 and by actuating the set screw 48 of the respective clamping element 20 and 22, respectively, the chin support 12 is clamped on the musical instrument 16. The clamping occurs from the side of the holding foot 34, i.e., with chin support 12 fitted, from the underside of the musical instrument. A suitable screwdriver is preferably delivered along with the inventive chin rest 10.

When the musical instrument 16 is held by way of the chin rest 10, the musician has no contact with metal parts on account of the clamping elements being made of plastic and the set screw 48 being embedded.

What is claimed is:

1. A chin rest for a musical instrument having a chin support and a holding device for holding said chin support on said musical instrument, said holding device comprising at least one clamping element which is adjustable for clamping said chin support to said musical instrument in a clamping direction, said chin support comprising an insertion guide for said at least one clamping element, said insertion guide being arranged and designed such that the inserting direction is at an incline to said clamping direction.

2. A chin rest as defined in claim 1, wherein said at least one clamping element is releasably held on said chin support by said insertion guide.

3. A chin rest as defined in claim 1, wherein said inserting direction lies at an angle in a range of between about 20° and 70° in relation to said clamping direction.

4. A chin rest as defined in claim 1, wherein said inserting direction lies at an angle in a range of between about 35° and 55° in relation to said clamping direction.

5. A chin rest as defined in claim 4, wherein the angle between the inserting direction and the clamping direction is essentially 45°.

6. A chin rest as defined in claim 1, wherein the insertion guide is formed by a recess in said chin support.

7. A chin rest as defined in claim 1, wherein the insertion guide comprises a guide channel for said clamping element.

8. A chin rest as defined in claim 7, wherein said insertion guide comprises a support channel communicating with said guide channel.

9. A chin rest as defined in claim 8, wherein said support channel comprises a contact surface for said clamping element, said contact surface lying essentially perpendicular to or at a small angle to said clamping direction.

10. A chin rest as defined in claim 7, wherein the insertion guide comprises two separate guide channels.

11. A chin rest as defined in claim 1, wherein the at least one clamping element is of two-part design, with a connecting element for connection to said chin support and a holding foot for resting against said musical instrument.

12. A chin rest as defined in claim 11, wherein said clamping element comprises an adjusting device for adjusting and fixing the relative position between the connecting element and the holding foot.

13. A chin rest as defined in claim 12, wherein said adjusting device comprises a screw connection.

14. A chin rest as defined in claim 13, wherein said clamping element comprises a counter receptacle for said screw connection.

15. A chin rest as defined in claim 14, wherein a screw nut is rotationally fixedly arranged in said counter receptacle.

16. A chin rest as defined in claim 14, wherein said counter receptacle is arranged in said connecting element.

17. A chin rest as defined in claim 13, wherein said screw connection is arranged within said clamping element.

18. A chin rest as defined in claim 11, wherein said connecting element comprises a displacement guide for said holding foot.

19. A chin rest as defined in claim 11, wherein said connecting element comprises a holding head whose design is adapted to said insertion guide.

20. A chin rest as defined in claim 19, wherein said holding head comprises a guide web which is adapted to a guide channel of said insertion guide.

21. A chin rest as defined in claim 20, wherein said guide web is arranged on said holding head so as to lie at the outer sides thereof.

22. A chin rest as defined in claim 19, wherein said holding head comprises a contact surface for resting against a corresponding contact surface of a support channel of said insertion guide.

23. A chin rest as defined in claim 19, wherein said holding head has an essentially U-shaped profile at an end which is provided for insertion into said insertion guide.

24. A chin rest as defined in claim 23, wherein guide webs are formed at sides of the end which is provided for insertion into said insertion guide.

25. A chin rest as defined in claim 11, wherein said connecting element comprises a plastic material.

26. A chin rest as defined in claim 11, wherein said holding foot comprises a plastic material.

27. A chin rest as defined in claim 1, wherein portions of the clamping element which may come into contact with a player's skin when a musical instrument is held by means of said chin rest are made from a material which is kind to the skin.

28. A chin rest as defined in claim 1, wherein a holding head of said clamping element is formed from walls having essentially the same wall thickness.

29. A chin rest as defined in claim 28, wherein said holding head has a central recess.

30. A chin rest as defined in claim 1, wherein said holding device comprises two clamping elements.

31. A chin rest as defined in claim 30, wherein two insertion guides arranged in spaced relation to each other are provided.

* * * * *